US010536993B2

(12) United States Patent
Kim et al.

(10) Patent No.: US 10,536,993 B2
(45) **Date of Patent: *Jan. 14, 2020**

(54) HEATING PASTE COMPOSITION, SURFACE TYPE HEATING ELEMENT USING THE SAME, AND PORTABLE LOW-POWER HEATER

(71) Applicant: KOREA ELECTRONICS TECHNOLOGY INSTITUTE, Seongnam-si, Gyeonggi-do (KR)

(72) Inventors: Yoonjin Kim, Suwon-si (KR); Jinwoo Cho, Seongnam-si (KR); Kwonwoo Shin, Hwaseong-si (KR); Jisun Park, Yongin-si (KR)

(73) Assignee: Korea Electronics Technology Institute, Gyeonggi-do (KR)

( * ) Notice: Subject to any disclaimer, the term of this patent is extended or adjusted under 35 U.S.C. 154(b) by 661 days.

This patent is subject to a terminal disclaimer.

(21) Appl. No.: 15/233,842

(22) Filed: Aug. 10, 2016

(65) Prior Publication Data

US 2016/0353524 A1 Dec. 1, 2016

Related U.S. Application Data

(63) Continuation of application No. PCT/KR2015/001067, filed on Feb. 2, 2015.

(30) Foreign Application Priority Data

Feb. 13, 2014 (KR) ..... 10-2014-0016668
Mar. 13, 2014 (KR) ..... 10-2014-0029744

(51) Int. Cl.
*H05B 3/14* (2006.01)
*H05B 3/26* (2006.01)
(Continued)

(52) U.S. Cl.
CPC ..... *H05B 3/145* (2013.01); *H01C 17/075* (2013.01); *H05B 3/265* (2013.01); *H05B 3/34* (2013.01);
(Continued)

(58) Field of Classification Search
None
See application file for complete search history.

(56) References Cited

U.S. PATENT DOCUMENTS 6,541,744 B2 * 4/2003 Von Arx ..... A47J 36/2483 219/544
7,135,396 B1 * 11/2006 Gabriel ..... H01L 21/32136 438/612
(Continued)

FOREIGN PATENT DOCUMENTS

JP 2009-109998 A 5/2009
JP 2009-543288 A 12/2009
(Continued)

OTHER PUBLICATIONS

International Search Report for International App. No. PCT/KR2015/001067 dated May 4, 2015.
(Continued)

*Primary Examiner* — Joseph M Pelham
(74) *Attorney, Agent, or Firm* — Knobbe, Martens, Olson & Bear, LLP

(57) ABSTRACT

The present disclosure relates to a heating paste composition which has heat stability, allows screen printing and gravure printing, has a small change in resistance depending on temperature, and can operate at low voltage and low power due to low specific resistance, to a surface type heating element using the same, and to a portable low-power heater. The heating paste composition may contain conductive particles including carbon nanotube particles and carbon
(Continued)

nanoparticles, a mixture binder including epoxy acrylate or hexamethylene diisocyanate, a polyvinyl acetal and a phenol-based resin, an organic solvent, and a dispersant.

20 Claims, 4 Drawing Sheets

(51) Int. Cl.
*H05B 3/34* (2006.01)
*H01C 17/075* (2006.01)

(52) U.S. Cl.
CPC .... *H05B 2203/013* (2013.01); *H05B 2214/04* (2013.01)

(56) References Cited

U.S. PATENT DOCUMENTS 9,832,818 B2* 11/2017 Decker ..... H05B 3/145
2006/0014012 A1* 1/2006 Thies ..... G02B 1/105 428/323
2006/0025515 A1* 2/2006 Scaringe ..... B82Y 30/00 524/496
2008/0166563 A1* 7/2008 Brittingham ..... C08J 3/18 428/411.1
2009/0194525 A1* 8/2009 Lee ..... H05B 3/145 219/553
2010/0021683 A1* 1/2010 Junghans ..... H05B 3/34 428/116
2010/0126985 A1* 5/2010 Feng ..... H05B 3/145 219/553
2010/0170889 A1* 7/2010 Keite-Telgenbuscher ..... C09J 7/38 219/546
2010/0213189 A1* 8/2010 Keite-Telgenbuescher ..... B60R 1/0602 219/548
2011/0214284 A1* 9/2011 Xu ..... H01B 1/22 29/825
2012/0025131 A1 2/2012 Forero
2012/0207525 A1 8/2012 Kim et al.
2013/0112214 A1* 5/2013 Bundren ..... D02G 1/00 131/280
2013/0222510 A1 11/2013 Kim et al.
2013/0302074 A1 11/2013 Lee et al.
2014/0263278 A1* 9/2014 Zakhidov ..... H05B 3/10 219/472
2015/0286073 A1* 10/2015 Blum ..... G02C 7/102 351/159.66
2015/0359043 A1* 12/2015 Kim ..... H05B 3/145 156/272.2
2015/0366005 A1* 12/2015 Janas ..... H05B 3/145 219/541
2016/0119977 A1* 4/2016 Caldeira ..... H05B 3/145 219/539
2016/0279639 A1* 9/2016 Kim ..... B01L 7/525
2017/0144408 A1* 5/2017 Sata ..... B32B 9/00
2018/0110097 A1* 4/2018 Fortenbacher ..... H05B 3/145
2019/0016232 A1* 1/2019 Kim ..... B60W 10/26

FOREIGN PATENT DOCUMENTS

JP 4527724 B 8/2010
JP 2012-214643 A 11/2012
KR 10-2012-0119124 A 10/2012
KR 10-1272959 B1 6/2013
KR 10-1294596 B1 8/2013
KR 10-2013-0097479 A 9/2013
KR 10-2013-0125275 A 11/2013
KR 10-2013-0092234 A 12/2013
WO WO 2004/023845 A1 3/2004

OTHER PUBLICATIONS

Notice of Allowance for KR App. No. KR 10-2014-0029744 dated Feb. 23, 2015.
Extended European Search Report issued in application No. 15749592.0 dated Jan. 18, 2017.
Office Action received in Korean Patent Application No. 10-2014-0016668, dated Apr. 30, 2019.

* cited by examiner

[Fig. 1]
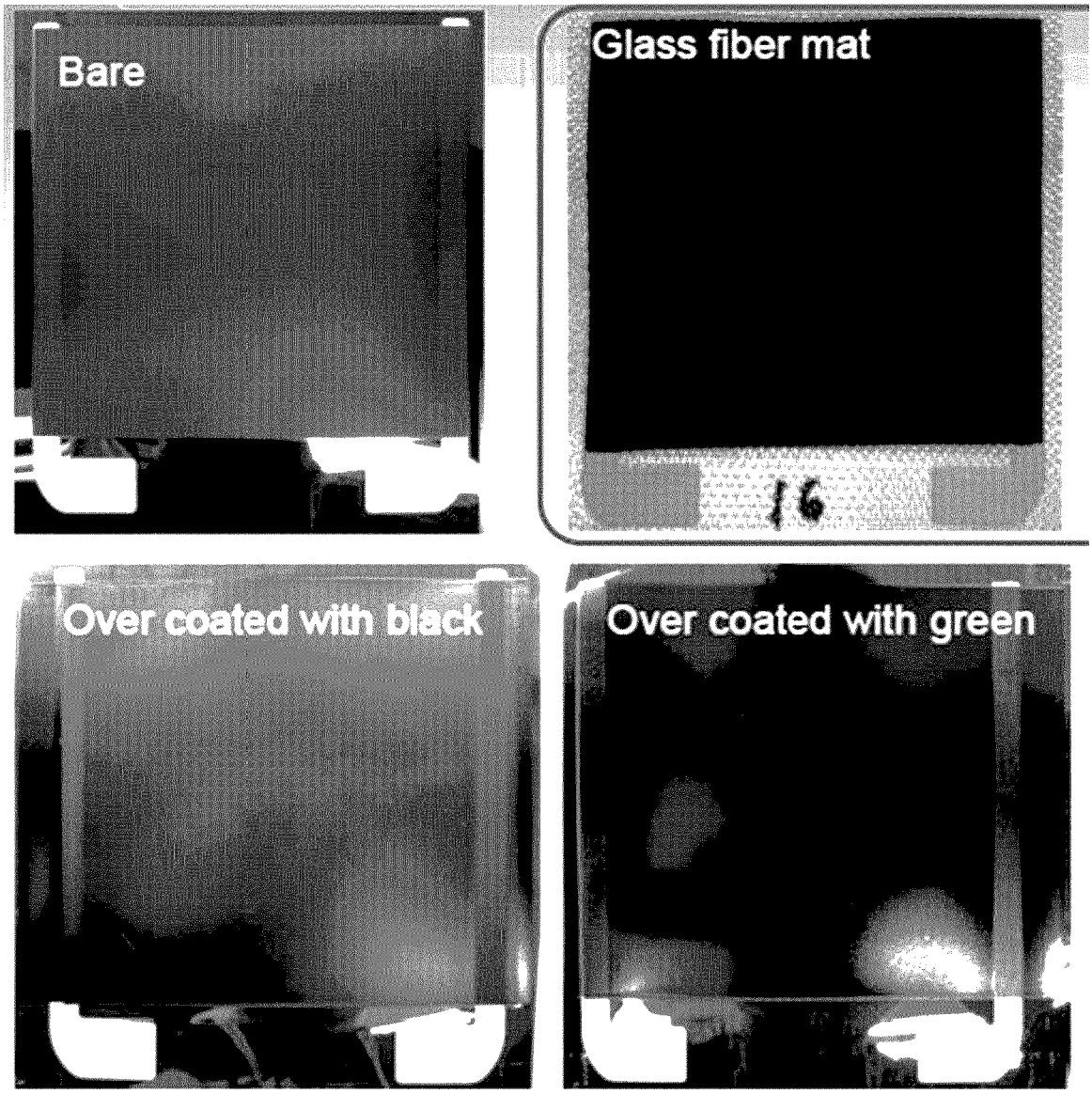

[Fig. 2]
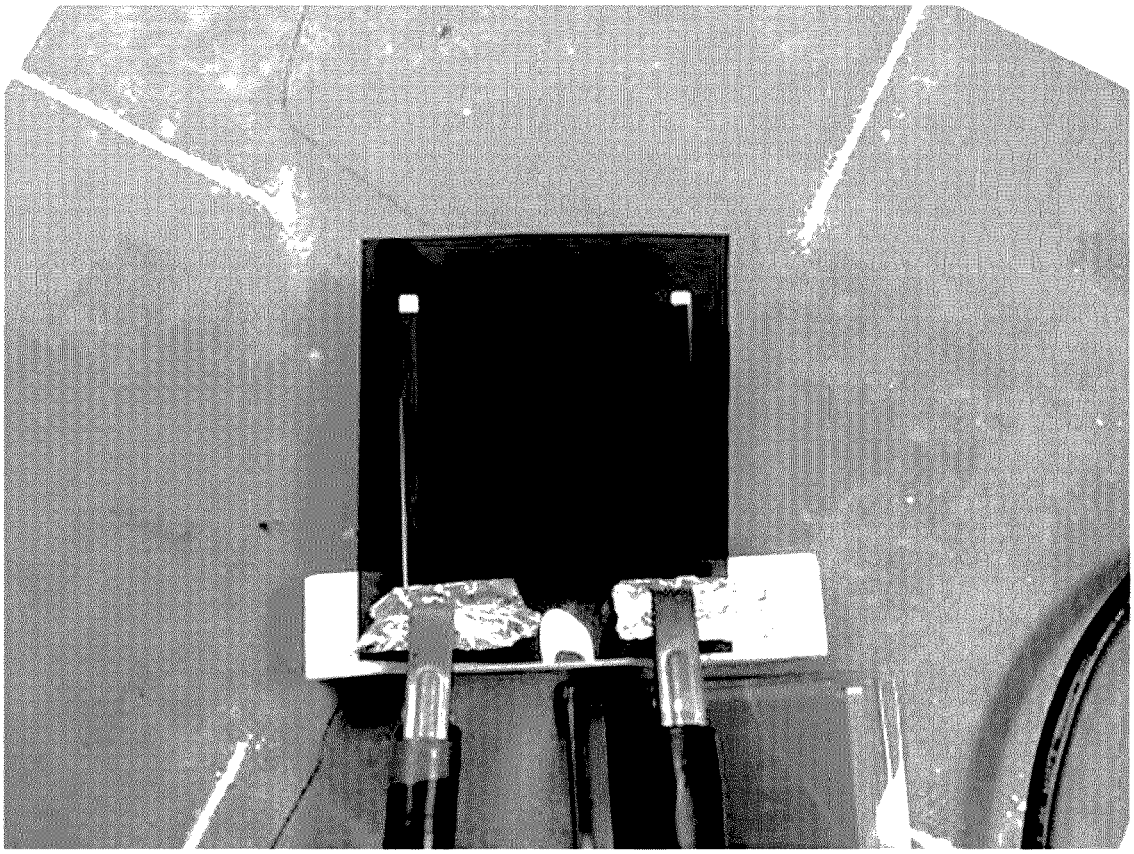
[Fig. 3]
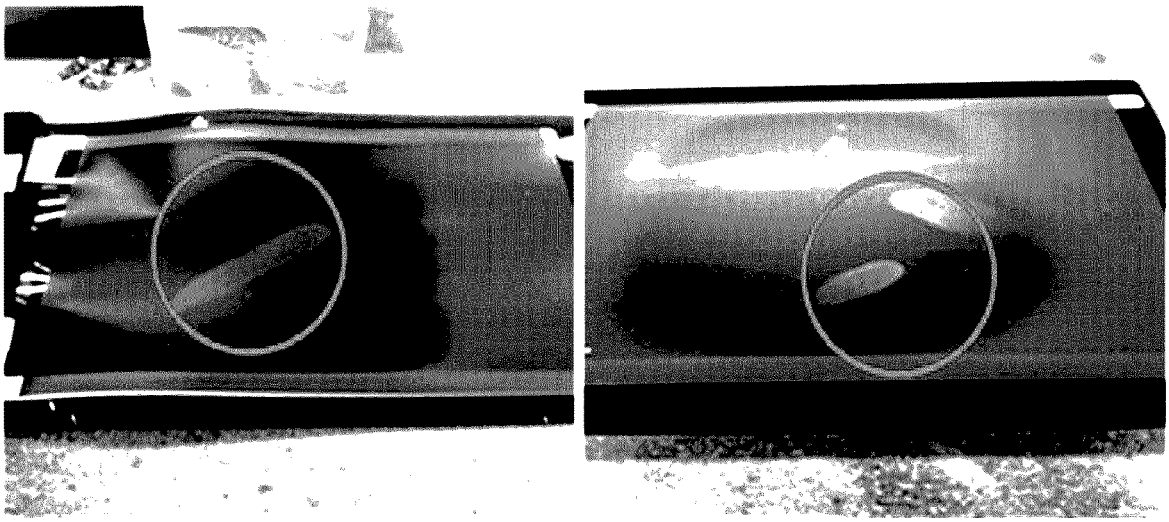

[Fig. 4]
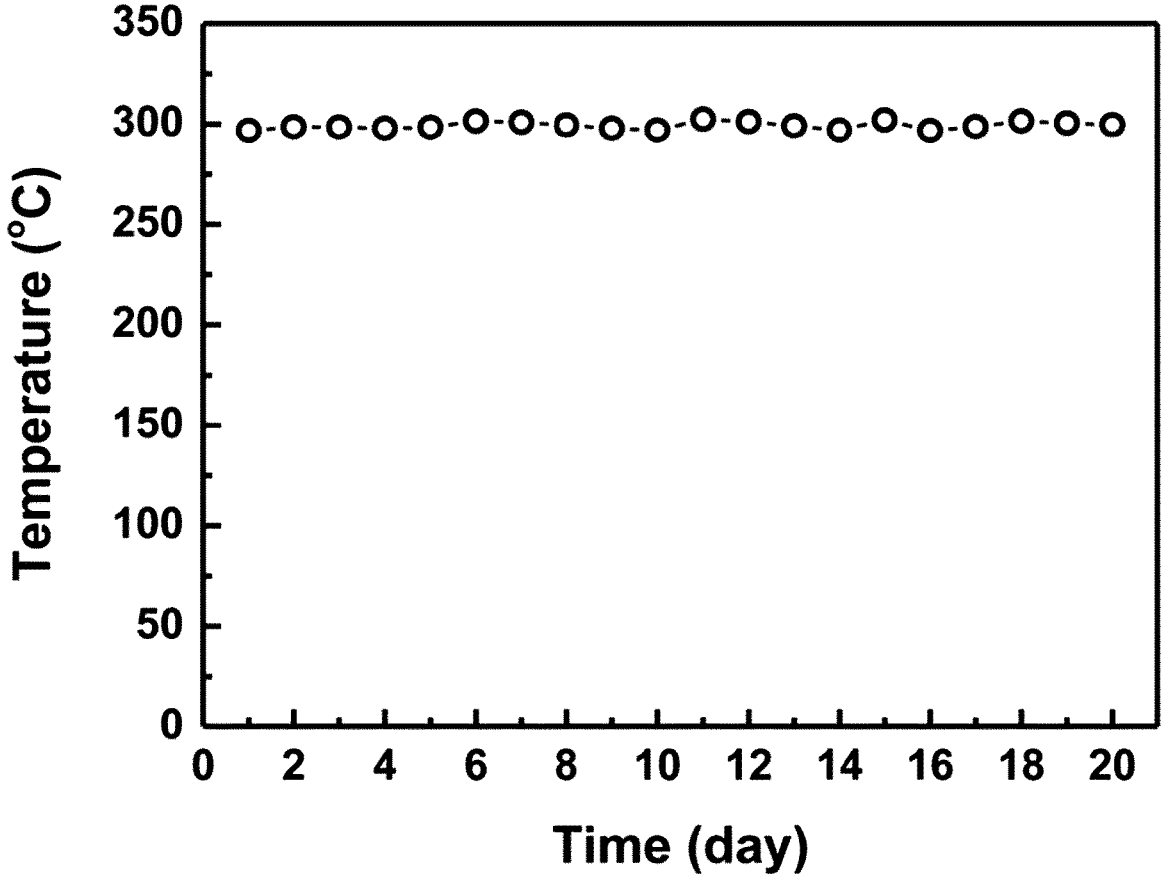

HEATING PASTE COMPOSITION, SURFACE TYPE HEATING ELEMENT USING THE SAME, AND PORTABLE LOW-POWER HEATER

CROSS-REFERENCE TO RELATED APPLICATIONS

Any and all priority claims identified in the Application Data Sheet, or any correction thereto, are hereby incorporated by reference under 37 CFR 1.57. For example, this application is a continuation application, and claims the benefit under 35 U.S.C. §§ 120 and 365 of PCT Application No. PCT/KR2015/001067, filed on Feb. 2, 2015, which is hereby incorporated by reference. PCT/KR2015/001067 also claimed priority from Korean Patent Application No. 10-2014-0016668 filed on Feb. 13, 2014 and Korean Patent Application No. 10-2014-0029744 filed on Mar. 13, 2014, each of which is hereby incorporated by reference.

BACKGROUND

Field

The described technology generally relates to a heating paste composition which has high heat stability and allows screen printing and gravure printing, and a surface type heating element and a portable low-power heater using the same and method of using the heating paste composition.

Description of the Related Technology

In a surface type heating element, heat is uniformly generated at a surface unlike a wire type heating element, and as a result, the surface type heating element has about 20% to about 40% higher energy efficiency than the wire type heating element. Also, a surface type heating element is a relatively safe type of heating element because electromagnetic waves are not emitted during direct current (DC) operation.

A surface type heating element is generally formed by uniformly spraying or printing metal heating elements such as iron, nickel, chromium, platinum and the like, all of which have high thermal conductivity, on a film, or by mixing inorganic particle heating elements such as carbon, graphite, carbon black and the like, all of which have conductivity, with a polymer resin. In recent years, a carbon-based surface type heating element which has not only superior heat stability on high temperature, durability, and thermal conductivity but also a low thermal expansion coefficient and light weight has been extensively studied as a surface type heating element.

SUMMARY

One inventive aspect relates to a heating paste composition which has heat stability even at a temperature of about 200° C. or more, which allows screen and gravure printing, and which allows heat curing at about 100° C. to about 180° C.

Another aspect is a surface type heating element and a portable low-power heater using the same.

Another aspect is a heating paste composition which has a small change in resistance depending on temperature and can operate at low voltage and low power due to low specific resistance, and a surface type heating element and a portable low-power heater using the same.

Another aspect is a heating paste composition including conductive particles containing carbon nanotube particles and carbon nanoparticles, a mixture binder in which epoxy acrylate or hexamethylene diisocyanate, a polyvinyl acetal resin, and a phenol-based resin are mixed, an organic solvent, and a dispersant.

In a heating paste composition according to an inventive aspect, 0.5 to 7 parts by weight of carbon nanotube particles, 0.5 to 30 parts by weight of carbon nanoparticles, 5 to 30 parts by weight of mixture binder, 29 to 92 parts by weight of organic solvent, 0.5 to 5 parts by weight of dispersant may be included with respect to 100 parts by weight of the heating paste composition.

In a heating paste composition according to an inventive aspect, 3 to 6 parts by weight of carbon nanotube particles, 0.5 to 30 parts by weight of carbon nanoparticles, 10 to 30 parts by weight of mixture binder, 29 to 83 parts by weight of organic solvent, 0.5 to 5 parts by weight of dispersant may be included with respect to 100 parts by weight of the heating paste composition.

In a heating paste composition according to an inventive aspect, the mixture binder may be prepared by mixing 10 to 150 parts by weight of the polyvinyl acetal resin and 10 to 500 parts by weight of the phenol-based resin with respect to 100 parts by weight of epoxy acrylate or hexamethylene diisocyanate.

In a heating paste composition according to an inventive aspect, the mixture binder may be prepared by mixing 10 to 150 parts by weight of polyvinyl acetal resin and 100 to 500 parts by weight of phenol-based resin with respect to 100 parts by weight of epoxy acrylate or hexamethylene diisocyanate.

In a heating paste composition according to an inventive aspect, the carbon nanotube particle may be a multi-wall carbon nanotube particle, and the carbon nanoparticle may be a graphite particle like thinner graphite particles.

In a heating paste composition according to an inventive aspect, the organic solvent may be a solvent mixture of two (2) or more selected among carbitol acetate, butyl carbitol acetate, dibasic ester (DBE), ethyl carbitol, ethyl carbitol acetate, dipropylene glycol methyl ether, cellosolve acetate, butyl cellosolve acetate, butanol, and octanol.

In a heating paste composition according to an inventive aspect, 0.5 to 5 parts by weight of a silane coupling agent may be further included with respect to 100 parts by weight of the heating paste composition.

Another aspect is a surface type heating element including a substrate; and a surface type heating element formed by screen printing, gravure printing, or comma coating the heating paste composition on the substrate.

In a surface type heating element according to an inventive aspect, the substrate may be a polyimide substrate, a glass fiber mat, or ceramic glass.

In some embodiments, the surface type heating element may further include a protective layer formed by coating an organic material containing silica or a black pigment such as carbon black on an upper surface of the surface type heating element.

Another aspect is a portable heater including a substrate, a surface type heating element formed by screen printing, gravure printing, or comma coating the heating paste composition on the substrate, and a power supply unit for supplying power for the surface type heating element.

Another aspect is a heating paste composition comprising: conductive particles including carbon nanotube particles and carbon nanoparticles; a mixture binder including epoxy acrylate or hexamethylene diisocyanate, a polyvinyl acetal resin, and a phenol-based resin; an organic solvent; and a dispersant.

In an inventive aspect, the heating paste composition may include 0.5 parts to 7 parts by weight of the carbon nanotube particles, 0.5 parts to 30 parts by weight of the carbon nanoparticles, 5 parts to 30 parts by weight of the mixture binder, 29 to 92 parts by weight of the organic solvent, and 0.5 parts to 5 parts by weight of the dispersant with respect to 100 parts by weight of the heating paste composition.

In an inventive aspect, the heating paste composition may include 3 parts to 6 parts by weight of the carbon nanotube particles, 0.5 parts to 30 parts by weight of the carbon nanoparticles, 10 parts to 30 parts by weight of the mixture binder, 29 parts to 83 parts by weight of the organic solvent, and 0.5 parts to 5 parts by weight of the dispersant with respect to 100 parts by weight of the heating paste composition.

In an inventive aspect, the heating paste composition may include 10 parts to 150 parts by weight of the polyvinyl acetal resin and 10 parts to 500 parts by weight of the phenol-based resin with respect to 100 parts by weight of the epoxy acrylate or hexamethylene diisocyanate.

In an inventive aspect, the heating paste composition may include 10 parts to 150 parts by weight of the polyvinyl acetal resin and 100 parts to 500 parts by weight of the phenol-based resin with respect to 100 parts by weight of the epoxy acrylate or hexamethylene diisocyanate.

In an inventive aspect, the carbon nanotube particles may include multi-wall carbon nanotube particles, and wherein the carbon nanoparticles may include graphite particles.

In an inventive aspect, the organic solvent may include a solvent mixture of two (2) or more selected from the group consisting of carbitol acetate, butyl carbitol acetate, dibasic ester (DBE), ethyl carbitol, ethyl carbitol acetate, dipropylene glycol methyl ether, cellosolve acetate, butyl cellosolve acetate, butanol, and octanol.

In an inventive aspect, the composition may further include a silane coupling agent in an amount of 0.5 parts to 5 parts by weight with respect to 100 parts by weight of the heating paste composition.

Another aspect is a surface type heating element comprising: a substrate; and a surface type heating element formed over the substrate and including conductive particles containing carbon nanotube particles and carbon nanoparticles; a mixture binder consisting of epoxy acrylate or hexamethylene diisocyanate, a polyvinyl acetal resin, and a phenol-based resin; an organic solvent; and a dispersant.

In a surface type heating element according to an inventive aspect, the substrate may be a polyimide substrate, a glass fiber mat, or ceramic glass.

In a surface type heating element according to an inventive aspect, the heating element may further comprise a protective layer including an organic material and formed on an upper surface of the surface type heating element.

Another aspect is a portable heater comprising: a substrate; a surface type heating including a heating paste composition and formed over the substrate; and a power supply unit configured to supply power for the surface type heating element, wherein the heating paste composition includes conductive particles containing carbon nanotube particles and carbon nanoparticles; a mixture binder including epoxy acrylate or hexamethylene diisocyanate, a polyvinyl acetal resin, and a phenol-based resin, an organic solvent and a dispersant.

Another aspect is a method of manufacturing a surface type heating element comprising: providing a substrate; and screen printing, gravure printing, or comma coating the heating paste composition of claim 1 over the substrate to form the surface type heating element.

In a method of manufacturing a surface type heating element according to an inventive aspect, the heating paste composition may include 0.5 parts to 7 parts by weight of the carbon nanotube particles, 0.5 parts to 30 parts by weight of the carbon nanoparticles, 5 parts to 30 parts by weight of the mixture binder, 29 parts to 92 parts by weight of the organic solvent, and 0.5 parts to 5 parts by weight of the dispersant with respect to 100 parts by weight of the heating paste composition.

In a method of manufacturing a surface type heating element according to an inventive aspect, the heating paste composition may include 3 parts to 6 parts by weight of the carbon nanotube particles, 0.5 parts to 30 parts by weight of the carbon nanoparticles, 10 parts to 30 parts by weight of the mixture binder, 29 parts to 83 parts by weight of the organic solvent, and 0.5 parts to 5 parts by weight of the dispersant with respect to 100 parts by weight of the heating paste composition.

In a method of manufacturing a surface type heating element according to an inventive aspect, the mixture binder may include 10 parts to 150 parts by weight of the polyvinyl acetal resin and 10 parts to 500 parts by weight of the phenol-based resin with respect to 100 parts by weight of the epoxy acrylate or hexamethylene diisocyanate.

In a method of manufacturing a surface type heating element according to an inventive aspect, the mixture binder may include 10 parts to 150 parts by weight of the polyvinyl acetal resin and 100 parts to 500 parts by weight of the phenol-based resin with respect to 100 parts by weight of the epoxy acrylate or hexamethylene diisocyanate.

In a method of manufacturing a surface type heating element according to an inventive aspect, the carbon nanotube particles may include multi-wall carbon nanotube particles, and wherein the carbon nanoparticles include graphite particles.

In a method of manufacturing a surface type heating element according to an inventive aspect, the organic solvent may include a solvent mixture of two (2) or more selected from the group consisting of carbitol acetate, butyl carbitol acetate, dibasic ester (DBE), ethyl carbitol, ethyl carbitol acetate, dipropylene glycol methyl ether, cellosolve acetate, butyl cellosolve acetate, butanol, and octanol.

Another aspect is a portable heater comprising: a substrate; a surface type heating element including the heating paste composition of claim 1 and formed over the substrate; and a power supply unit configured to supply power for the surface type heating element.

Certain Advantageous Effects

In some embodiments, a heating paste composition can maintain heat stability even at a temperature of 200° C. or more, and therefore, a surface type heating element capable of being heated to a high temperature can be provided.

In addition, a heating paste composition according to an inventive aspect allows screen printing or gravure printing, and as a result, it is advantageous for mass production. Besides, a product can be designed depending on various resistance ranges and sizes since a thickness of the surface type heating element is easily adjusted, and it can be applied to various flexible substrates since heat curing can be performed at about 100° C. to 180° C.

Additionally, a heating paste composition according to an inventive aspect can maintain heat stability even at a temperature of 200° C. or more, and as a result, it is stable due to a small change in resistance depending on a temperature.

In addition, a heating paste composition according to an inventive aspect can generate high-temperature heat at low voltage and low power since it has low specific resistance (volume resistivity) and a thickness is easily adjusted, and as a result, a portable heater which has higher efficiency can be produced.

BRIEF DESCRIPTION OF THE DRAWINGS

FIG. 1 is an image of surface type heating element samples produced using a heating paste composition according to embodiments.

FIG. 2 is an image illustrating a scene where the heating stability of surface type heating element samples produced according to embodiments and comparative examples is tested.

FIG. 3 is an image illustrating that a surface of a surface type heating element according to Comparative Example 1 swells during heating operation at 200° C.

FIG. 4 is a graph illustrating that stability of a surface type heating element according to Embodiment 1 is maintained for 20 days during heating operation at 300° C.

DETAILED DESCRIPTION

Figure 5:
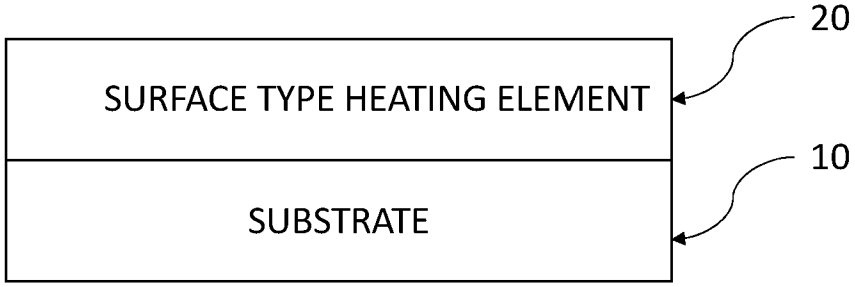
FIG. 5 illustrates an embodiment including a substrate and a surface type heating element formed over the substrate.

Generally a surface type heating element using a carbon-based material is made of a paste formed by mixing conductive carbon-based powder such as carbon, graphite, carbon black, carbon nanotube (CNT) and the like and a binder, wherein conductivity, workability, adhesion, scratch resistance and the like are determined depending on usage amounts of a conductive material and binder.

However, it is difficult for a typical CNT-based heating paste to have high heat stability, and particularly, no heating pastes which allow screen printing, gravure printing, or comma coating and have high heat stability at a temperature of about 200° C. to 300° C. have been reported. Also, even when the CNT-based heating paste is formulated to have high heat stability a problem of applying the CNT-based heating paste to a flexible substrate made of plastic has been observed since a drying temperature (curing temperature) during preparation approaches 300° C.

Meanwhile, a typical carbon-based heating paste has relatively high specific resistance, a thick film process is not easily progressed, and as a result, there is a problem in which it is difficult to operate a heater using the same at low voltage and low power.

The following descriptions will be made focusing on configurations necessary for understanding embodiments of the present disclosure. Therefore, it should be noted that descriptions of other configurations will be omitted within a range in which the gist of the present embodiments is not obscured.

Terms and words used in this specification and claims should not be interpreted as limited to commonly used meanings or meanings in dictionaries and should be interpreted with meanings and concepts which are consistent with the technological scope of the embodiments based on the principle that the inventors have appropriately defined concepts of terms in order to describe the invention in the best way. Therefore, since the embodiments described in this specification and configurations illustrated in drawings are only exemplary embodiments and do not represent the overall technological scope of the invention, it should be understood that the described technology covers various equivalents, modifications, and substitutions at the time of filing of this application.

Hereinafter, embodiments of the present disclosure will be described in detail with reference to the accompanying drawings.

A heating paste composition according to an embodiment includes carbon nanotube particles, carbon nanoparticles (CNPs, graphite nanoparticles), a mixture binder, an organic solvent, and a dispersant.

In some embodiments, 0.5 to 7 parts by weight of carbon nanotube particles, 0.5 to 30 parts by weight of carbon nanoparticles, 5 to 30 parts by weight of mixture binder, 29 to 92 parts by weight of organic solvent, 0.5 to 5 parts by weight of dispersant are included with respect to 100 parts by weight of the heating paste composition.

In some embodiments, 3 to 6 parts by weight of carbon nanotube particles, 0.5 to 30 parts by weight of carbon nanoparticles, 10 to 30 parts by weight of mixture binder, 29 to 83 parts by weight of organic solvent, 0.5 to 5 parts by weight of dispersant are included with respect to 100 parts by weight of the heating paste composition.

In some embodiments, the carbon nanotube particle may be selected from a single-walled carbon nanotube, a double-walled carbon nanotube, a multi-walled carbon nanotube, or a mixture thereof. For example, the carbon nanotube particle may be a multi-walled carbon nanotube. In some embodiments, a diameter thereof may be about 5 nm to about 30 nm and a length thereof may be about 3 μm to about 40 μm when the carbon nanotube particle is a multi-walled carbon nanotube.

In some embodiments, the carbon nanoparticle may be, for example, a graphite nanoparticle, a diameter of which may be about 1 μm to about 25 μm.

In some embodiments, the mixture binder serves to allow a heating paste composition to have heat stability even at a temperature of about 300° C., and is in the form of a mixture of epoxy acrylate or hexamethylene diisocyanate, a polyvinyl acetal resin, and a phenol-based resin. For example, the mixture binder may be in the form of a mixture of epoxy acrylate, a polyvinyl acetal resin, and a phenol-based resin, or may be in the form of a mixture of hexamethylene diisocyanate, a polyvinyl acetal resin, and a phenol-based resin. In some embodiments, even when high temperature heat of about 300° C. is generated, there is an advantage that resistance of a material does not change or a coating film is not damaged by improving heat stability of the mixture binder.

Here, the phenol-based resin refers to a phenol-based compound including phenol and a phenol derivative. For example, the phenol derivative may be p-cresol, o-guaiacol, creosol, catechol, 3-methoxy-1,2-benzenediol, homocatechol, vinylguaiacol, syringol, isoeugenol, methoxyeugenol, o-cresol, 3-methyl-1,2-benzenediol, (z)-2-methoxy-4-(1-propenyl)-phenol, 2,6-dimethoxy-4-(2-propenyl)-phenol, 3,4-dimethoxy-phenol, 4-ethyl-1,3-benzenediol, resole phenol, 4-methyl-1,2-benzenediol, 1,2,4-benzenetriol, 2-methoxy-6-methylphenol, 2-methoxy-4-vinylphenol, or 4-ethyl-2-methoxy-phenol), but the described technology is not limited thereto.

In some embodiments, a mixing ratio of the mixture binder may be a ratio of 10 to 150 parts by weight of the polyvinyl acetal resin and 10 to 500 parts by weight of the phenol-based resin with respect to 100 parts by weight of epoxy acrylate or hexamethylene diisocyanate. When a content of a phenol-based resin is 10 parts by weight or less, the heat stability of a heating paste composition is degraded, and when a content of a phenol-based resin is more than 500 parts by weight, flexibility is degraded (increased brittleness).

In some embodiments, a mixing ratio of the mixture binder may be a ratio of 10 to 150 parts by weight of the polyvinyl acetal resin and 100 to 500 parts by weight of the phenol-based resin with respect to 100 parts by weight of epoxy acrylate or hexamethylene diisocyanate.

In some embodiments, the organic solvent may be for dispersing conductive particles and a mixture binder, and may be a solvent mixture of 2 or more selected among carbitol acetate, butyl carbitol acetate, dibasic ester (DBE), ethyl carbitol, ethyl carbitol acetate, dipropylene glycol methyl ether, cellosolve acetate, butyl cellosolve acetate, butanol, and octanol.

In some embodiments, a process for dispersion may be performed through various generally used methods, for example, ultrasonication, roll milling, bead milling, or ball milling.

In some embodiments, the dispersant may be for more smooth dispersion, and a general dispersant such as BYK types, an amphoteric surfactant such as Triton X-100, and an ionic surfactant such as SDS and the like may be used.

In some embodiments, the heating paste composition may further include 0.5 to 5 parts by weight of a silane coupling agent with respect to 100 parts by weight of the heating paste composition.

In some embodiments, the silane coupling agent serves as an adhesion promoter which increases an adhesive force between a heating paste composition and a substrate. In some embodiments, the silane coupling agent may be an epoxy—containing silane or a mercapto-containing silane. Such a silane coupling agent may be, for example, 2-(3,4-epoxycyclohexyl)-ethyltrimethoxysilane, 3-glycidoxytrimethoxysilane, 3-glycidoxypropyltriethoxysilane, 3-glycidoxypropyltriethoxysilane, all of which contain an epoxy group, N-2(aminoethyl)3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysily-N-(1,3-dimethylbutylidene)propylamine, N-phenyl-3-aminopropyltrimethoxysilane, all of which contain an amine group, 3-mercaptopropylmethyldimethoxysilane, 3-mercaptopropyltriethoxysilane, all of which contain a mercapto group, and 3-isocyanatepropyltriethoxysilane, etc. which contains an isocyanate group, but the described technology is not limited thereto.

Some embodiments provide a surface type heating element including a surface type heating element formed by screen printing, gravure printing (or roll to roll gravure printing), or comma coating (or roll to roll comma coating) a heating paste composition according to embodiments on a substrate.

In some embodiments, polycarbonate, polyethylene terephthalate (PET), polyethylene naphthalate (PEN), polyimide, cellulose ester, nylon, polypropylene, polyacrylonitrile, polysulfone, polyestersulfone, polyvinylidene fluoride, glass, glass fiber (mat), a ceramic, SUS, copper, or an aluminum substrate may be used as the substrate, but the described technology is not limited thereto. In some embodiments, the substrate may be properly selected depending on an application field or an operating temperature of a heating element.

In some embodiments, a surface type heating element is printed by screen printing or gravure printing a heating paste composition as disclosed and described herein on a substrate so as to form a desired pattern, dried, and cured. In this case, drying and curing may be performed at about 100° C. to about 180° C. In some embodiments, an electrode may be formed by printing a silver paste or a conductive paste on the upper surface of the surface type heating element and drying/curing, thereby producing a surface type heating element.

In some embodiments, a silver paste or a conductive paste may be printed on a substrate and dried/cured, and then a heating paste composition as disclosed and described herein may be screen printed or gravure printed on an upper surface, dried, and cured, thereby producing a surface type heating element.

In some embodiments, a surface type heating element may further include a protective layer coated on an upper surface. In some embodiments, the protective layer may be formed of resins including silica ($SiO_2$). In some embodiments, the flexibility of a heating element may be maintained even though a heating surface is coated when a protective layer is formed of resins including silica.

Hereinafter, a heating paste composition for forming a thick film and a surface type heating element using the same will be described in detail through examples. The following examples are only exemplary for describing the present embodiments, but the described technology is not limited thereto.

EXAMPLE (1) Preparation for Example Embodiments and Comparative Examples

As seen in the following Table 1, embodiments (3 types) and comparative examples (3 types) were prepared.

It should be understood that composition ratios shown in Table 1 are described in % by weight.

TABLE 1

| | Embodiment 1 | Embodiment 2 | Embodiment 3 | Comparative Example 1 | Comparative Example 2 | Comparative Example 3 |
|---|---|---|---|---|---|---|
| CNT particles | 4 | 5 | 6 | 4 | 5 | 6 |
| CNPs | 8 | 9 | 15 | — | — | — |
| mixture binder | 20 | 15 | 22 | — | — | — |
| ethyl cellulose | — | — | — | 10 | 12 | 14 |
| organic solvent | 63 | 67 | 52 | 82 | 79 | 76 |
| dispersant (BYK) | 5 | 4 | 5 | 4 | 4 | 4 |

CNT particles and CNPs (Embodiments 1 to 3) were added into a carbitol acetate solvent in amounts listed in Table 1, a BYK dispersant was added thereto, and then a dispersion solution A was prepared through ultrasonication for 60 minutes to provide a mixture containing carbitol acetate solvent. Afterward, a mixture binder was added into the mixture containing a carbitol acetate solvent, and then a master batch was prepared through mechanical stirring. Next, the dispersion solution A and the master batch were initially kneaded through mechanical stirring, and then were secondarily kneaded through a 3-roll milling process to prepare a heating paste composition.

In the case of the comparative examples, CNT particles were added into a carbitol acetate solvent in amounts listed in Table 1, a BYK dispersant was added thereto, and then a dispersion solution B was prepared through ultrasonication for 60 minutes to provide a mixture containing carbitol acetate solvent. Afterward, ethyl cellulose was added into the mixture containing a carbitol acetate solvent, and then a master batch was prepared through mechanical stirring. Next, the dispersion solution B and the master batch were initially kneaded through mechanical stirring, and then were secondarily kneaded through a 3-roll milling process to prepare a heating paste composition.

(2) Characteristic Evaluation of a Surface Type Heating Element

The heating paste compositions according to the Example embodiments and comparative examples were screen printed on a polyimide substrate to a size of 10×10 cm, cured, and then a silver paste electrode was printed at both ends of an upper surface, cured to prepare a surface type heating element sample.

FIG. 1 is an image of a surface type heating element specimen produced using a heating paste composition according to the Example embodiments. (a) of FIG. 1 illustrates a surface type heating element formed by screen printing a heating paste composition on a polyimide substrate. (b) of FIG. 1 illustrates a surface type heating element formed by screen printing a heating paste composition on a glass fiber mat. (c) of FIG. 1 and (d) of FIG. 1 are images where a protective layer is coated on an upper surface of a surface type heating element of (a) of FIG. 1 (coated with a black protective layer in (c) of FIG. 1, coated with a green protective layer in (d) of FIG. 1).

As shown in FIG. 1A, the specific resistances of surface type heating element samples (Example embodiments) and surface type heating element samples produced according to comparative examples were measured (applied voltage/current are shown in Table 2). Also, in order to confirm heating up effects according to applied voltage/current, the temperature of each of the surface type heating elements according to the Example embodiments and comparative examples was increased to 40° C., 100° C., and 200° C., and when the temperature was reached, DC voltage and current were measured.

In addition, the heating stability of each sample was tested at 200° C. FIG. 2 is an image illustrating a scene where the heating stability of surface type heating element samples produced according to the Example embodiments and comparative examples is tested, a result of which was shown in the following Table 2.

Referring to Table 2, with respect to specific resistance, surface type heating elements according to the Example embodiments measured lower than surface type heating elements according to comparative examples, and accordingly, with respect to the operating voltage/current necessary for reaching each temperature, surface type heating elements according to embodiments also measured lower than surface type heating elements according to comparative examples. That is, it can be seen that surface type heating elements according to the Example embodiments are capable of operating at low voltage and low power compared to those of comparative examples.

Specifically, in the surface type heating elements according to Example embodiments 1 to 3, stability was maintained for 20 days even during heating operation at 300° C. (no additional protective layer), whereas, in comparative examples 1 to 3, a defect phenomenon in which surfaces of heating parts swell within 2 hours was observed even during heating operation at 200° C. (it is possible to increase the temperature to 300° C., but the defect phenomenon has already occurred at 200° C.). FIG. 3 illustrates an image showing that a surface of a surface type heating element according to comparative example 1 swells during heating operation at 200° C., and FIG. 4 illustrates a graph showing that the stability of a surface type heating element according to Example embodiment 1 is maintained for 20 days during heating operation at 300° C. (X-axis denotes time (day), and Y-axis denotes a heating operation temperature in FIG. 4). Referring to FIG. 4, it can be seen that a surface type heating element prepared using a heating paste composition according to the Example embodiments operates stably for 20 days during heating operation at 300° C. FIG. 5 shows an embodiment including a substrate 10 and a surface type heating element 20 formed over the substrate, wherein the embodiment can be used in, for example, a surface type heating element device and/or a portable heater.

Therefore, it can be seen that a heating paste composition according to the Example embodiments can maintain heat stability even at a temperature of 200° C. or more, for example, about 300° C., and as a result, a surface type heating element capable of being heated to a high temperature can be provided.

TABLE 2

| | Embodiment 1 | Embodiment 2 | Embodiment 3 | Comparative Example 1 | Comparative Example 2 | Comparative Example 3 |
|---|---|---|---|---|---|---|
| specific resistance ($\times 10^{-2}$ Ωcm) | 1.9 | 2.55 | 2.96 | 9.73 | 8.52 | 6.23 |
| DC operating voltage/current when reaching 40° C. | 5 V/0.2 A | 6 V/0.2 A | 7 V/0.2 A | 20 V/0.3 A | 16 V/0.2 A | 12 V/0.2 A |
| DC operating voltage/current when reaching 100° C. | 9 V/0.5 A | 12 V/0.4 A | 14 V/0.5 A | 48 V/0.7 A | 40 V/0.7 A | 26 V/0.6 A |
| DC operating voltage/current when reaching 200° C. | 20 V/0.6 A | 24 V/0.7 A | 24 V/1.0 A | — | — | — |
| heating stability (day) | 20 days or more | 20 days or more | 20 days or more | defect | defect | defect |

The described technology further provides a portable heater including the above-described surface type heating element and a power supply unit for supplying power for the surface type heating element.

In some embodiments, the power supply unit may include a lead electrode which is applied on the left and right sides of a surface type heating element, and an electrode for connecting power, which is attached to the lead electrode. In some embodiments, the electrode for connecting power may be directly connected to a surface type heating element. In some embodiments, the lead electrode or the electrode for connecting power may be formed using a silver paste, a copper paste, a copper tape and the like.

The described technology provides portable heater having a surface type heating element attached, embedded, or installed inside or outside a body of the portable heater, and a power supply unit for driving a surface type heating element. Such a portable heater is usable for an inner seat for a stroller, heating socks, heating shoes, a heating hat, a portable heating mat, a portable cooking utensil, a heating seat for a vehicle and the like.

In particular, a surface type heating element used for a portable heater according to the present embodiments, as described above, can operate at low voltage and low power, and as a result, the surface type heating element has advantages of being capable of operating through secondary batteries such as a lithium-ion battery, a lithium polymer battery and the like, all of which are capable of charge and discharge, improving portability, and greatly prolonging usage time.

While the inventive technology has been described in detail with reference to exemplary embodiments and the accompanying drawings, it will be understood by those skilled in the art that various substitutions, additions, and changes may be made without departing from the spirit and scope of the appended claims.

What is claimed is:

1. A heating paste composition comprising:

conductive particles including carbon nanotube particles and carbon nanoparticles;

a mixture binder including epoxy acrylate or hexamethylene diisocyanate, a polyvinyl acetal resin, and a phenol-based resin;

an organic solvent; and a dispersant.

2. The heating paste composition of claim 1, wherein the heating paste composition includes 0.5 parts to 7 parts by weight of the carbon nanotube particles, 0.5 parts to 30 parts by weight of the carbon nanoparticles, 5 parts to 30 parts by weight of the mixture binder, 29 to 92 parts by weight of the organic solvent, and 0.5 parts to 5 parts by weight of the dispersant with respect to 100 parts by weight of the heating paste composition.

3. The heating paste composition of claim 1, wherein the heating paste composition includes 3 parts to 6 parts by weight of the carbon nanotube particles, 0.5 parts to 30 parts by weight of the carbon nanoparticles, 10 parts to 30 parts by weight of the mixture binder, 29 parts to 83 parts by weight of the organic solvent, and 0.5 parts to 5 parts by weight of the dispersant with respect to 100 parts by weight of the heating paste composition.

4. The heating paste composition of claim 1, wherein the mixture binder includes 10 parts to 150 parts by weight of the polyvinyl acetal resin and 10 parts to 500 parts by weight of the phenol-based resin with respect to 100 parts by weight of the epoxy acrylate or hexamethylene diisocyanate.

5. The heating paste composition of claim 1, wherein the mixture binder includes 10 parts to 150 parts by weight of the polyvinyl acetal resin and 100 parts to 500 parts by weight of the phenol-based resin with respect to 100 parts by weight of the epoxy acrylate or hexamethylene diisocyanate.

6. The heating paste composition of claim 1, wherein the carbon nanotube particles include multi-wall carbon nanotube particles, and wherein the carbon nanoparticles include graphite particles.

7. The heating paste composition of claim 1, wherein the organic solvent includes a solvent mixture of two (2) or more selected from the group consisting of carbitol acetate, butyl carbitol acetate, dibasic ester (DBE), ethyl carbitol, ethyl carbitol acetate, dipropylene glycol methyl ether, cellosolve acetate, butyl cellosolve acetate, butanol, and octanol.

8. The heating paste composition of claim 1, further comprising:

a silane coupling agent in an amount of 0.5 parts to 5 parts by weight with respect to 100 parts by weight of the heating paste composition.

9. A portable heater comprising:

a substrate;

a surface type heating element including the heating paste composition of claim 1 and formed over the substrate; and a power supply unit configured to supply power for the surface type heating element.

10. A surface type heating element comprising:

a substrate; and a surface type heating element formed over the substrate and including conductive particles containing carbon nanotube particles and carbon nanoparticles;

a mixture binder consisting of epoxy acrylate or hexamethylene diisocyanate, a polyvinyl acetal resin, and a phenol-based resin;

an organic solvent; and a dispersant.

11. The surface type heating element of claim 10, wherein the substrate is a polyimide substrate, a glass fiber mat, or ceramic glass.

12. The surface type heating element of claim 10, further comprising:

a protective layer including an organic material and formed on an upper surface of the surface type heating element.

13. A portable heater comprising:

a substrate;

a surface type heating element including a heating paste composition and formed over the substrate; and a power supply unit configured to supply power for the surface type heating element, wherein the heating paste composition includes conductive particles containing carbon nanotube particles and carbon nanoparticles; a mixture binder including epoxy acrylate or hexamethylene diisocyanate, a polyvinyl acetal resin, and a phenol-based resin, an organic solvent and a dispersant.

14. A method of manufacturing a surface type heating element comprising:

providing a substrate; and screen printing, gravure printing, or comma coating the heating paste composition of claim 1 over the substrate to form the surface type heating element.

15. The method of claim 14, wherein the heating paste composition includes 0.5 parts to 7 parts by weight of the carbon nanotube particles, 0.5 parts to 30 parts by weight of the carbon nanoparticles, 5 parts to 30 parts by weight of the mixture binder, 29 parts to 92 parts by weight of the organic solvent, and 0.5 parts to 5 parts by weight of the dispersant with respect to 100 parts by weight of the heating paste composition.

16. The method of claim 14, wherein the heating paste composition includes 3 parts to 6 parts by weight of the carbon nanotube particles, 0.5 parts to 30 parts by weight of the carbon nanoparticles, 10 parts to 30 parts by weight of the mixture binder, 29 parts to 83 parts by weight of the organic solvent, and 0.5 parts to 5 parts by weight of the dispersant with respect to 100 parts by weight of the heating paste composition.

17. The method of claim 14, wherein the mixture binder includes 10 parts to 150 parts by weight of the polyvinyl acetal resin and 10 parts to 500 parts by weight of the phenol-based resin with respect to 100 parts by weight of the epoxy acrylate or hexamethylene diisocyanate.

18. The method of claim 14, wherein the mixture binder includes 10 parts to 150 parts by weight of the polyvinyl acetal resin and 100 parts to 500 parts by weight of the phenol-based resin with respect to 100 parts by weight of the epoxy acrylate or hexamethylene diisocyanate.

19. The method of claim 14, wherein the carbon nanotube particles include multi-wall carbon nanotube particles, and wherein the carbon nanoparticles include graphite particles.

20. The method of claim 14, wherein the organic solvent includes a solvent mixture of two (2) or more selected from the group consisting of carbitol acetate, butyl carbitol acetate, dibasic ester (DBE), ethyl carbitol, ethyl carbitol acetate, dipropylene glycol methyl ether, cellosolve acetate, butyl cellosolve acetate, butanol, and octanol.

* * * * *